United States Patent [19]

Lancet

[11] 4,248,605

[45] Feb. 3, 1981

[54] GASIFICATION OF COAL LIQUEFACTION RESIDUES

[75] Inventor: Michael S. Lancet, Pittsburgh, Pa.

[73] Assignee: Conoco, Inc., Stamford, Conn.

[21] Appl. No.: 62,071

[22] Filed: Jul. 30, 1979

[51] Int. Cl.[3] ..... C10J 3/54

[52] U.S. Cl. ..... 48/197 R; 44/10 R; 208/8 LE; 423/648 R

[58] Field of Search ..... 48/197 R, 202, 210; 252/373, 413; 201/31, 38; 208/8 LE; 423/431, 560, 648 R; 44/10 R, 16 C

[56] References Cited

U.S. PATENT DOCUMENTS

| | | | |
|---|---|---|---|
| 2,709,126 | 5/1955 | Gollman | 423/560 |
| 3,847,563 | 11/1974 | Auhr et al. | 48/197 R |
| 4,060,478 | 11/1977 | Long | 208/8 LE |
| 4,138,224 | 2/1979 | Gorin | 208/8 LE |

*Primary Examiner*—Peter F. Kratz

*Attorney, Agent, or Firm*—F. Lindsey Scott; William A. Mikesell, Jr.

[57] ABSTRACT

A method for gasifying the bottoms fraction from a coal liquefaction process by mixing the bottoms fraction with at least one finely-divided calcium compound selected from the group consisting of calcium oxide, calcium carbonate and calcium hydroxide with the calcium compound being of a size consist no larger than about −200 Tyler mesh and present in an amount sufficient to produce agglomerate particles upon mixing with the bottoms fraction and thereafter gasifying the resulting agglomerate particles by reacting the agglomerate particles with steam in a fluidized bed.

6 Claims, 2 Drawing Figures

GASIFICATION OF COAL LIQUEFACTION RESIDUES

Figure 1:
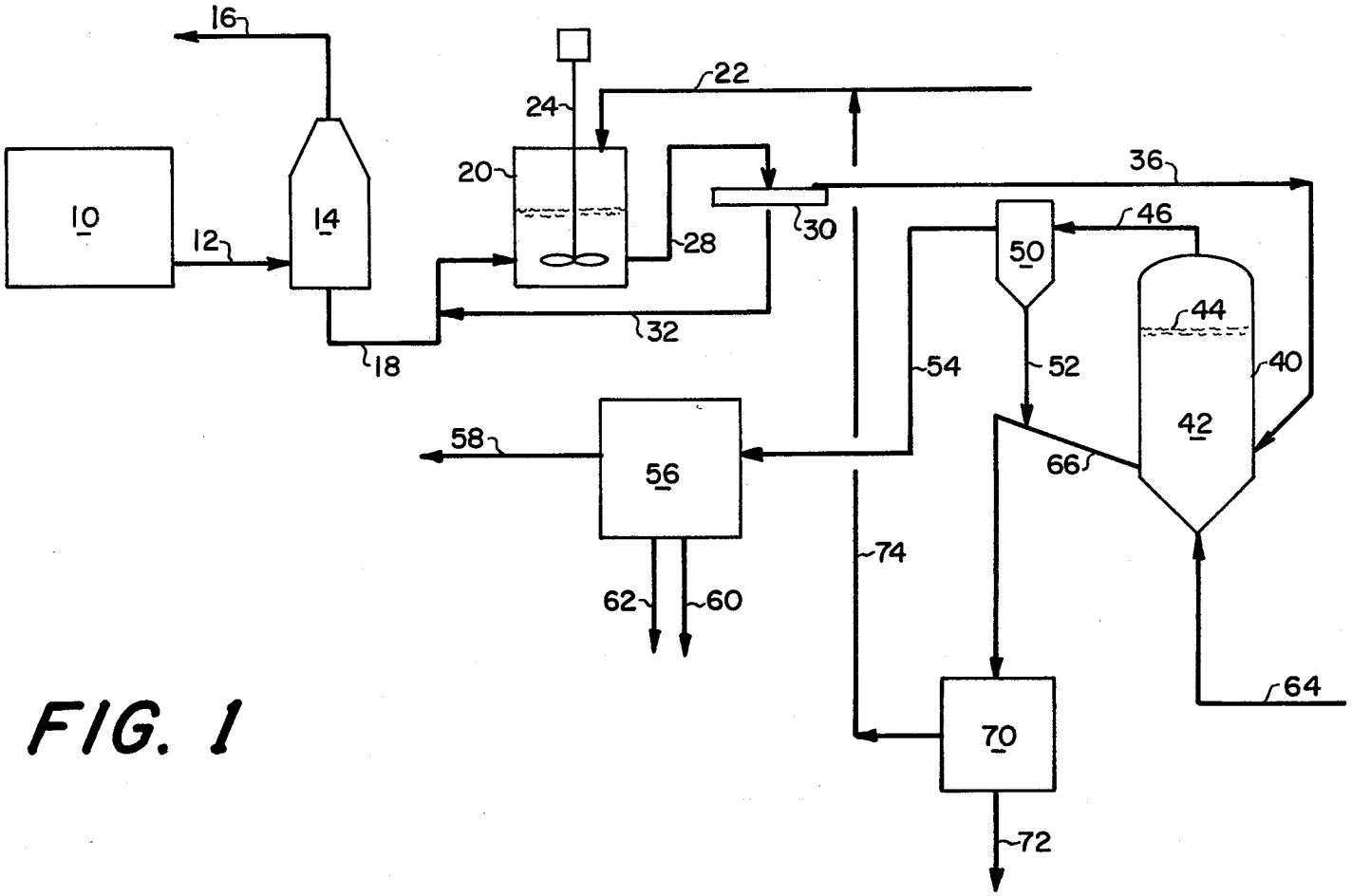

This invention relates to the gasification of a bottoms fraction from a coal liquefaction process.

This invention further relates to a method for gasifying a bottoms fraction from a coal liquefaction process wherein the bottoms fraction is mixed with an amount of finely-divided calcium compound sufficient to produce agglomerate particles upon mixing.

In view of the continuing and well known shortage of natural gas continuing effort has been directed to the development of processes whereby synthetic gaseous fuels can be produced from other more abundant fuels such as coal and the like. One such process comprises the reaction of steam with a carbonaceous fuel such as coal in the presence of a $CO_2$ acceptor such as calcium oxide to produce synthetic fuels which are rich in hydrogen. Some processes of this type are disclosed in the following United States Patents:

| | | |
|---|---|---|
| U.S. Pat. No. | 2,654,661 | Gorin |
| | 2,654,662 | Gorin |
| | 2,654,663 | Gorin |
| | 2,682,455 | Gorin |
| | 2,682,456 | Gorin |
| | 2,682,457 | Gorin |
| | 2,705,672 | Gorin |
| | 2,781,248 | Gorin |
| | 2,807,529 | Tarbox |
| | 3,108,857 | Gorin et al. |
| | 3,115,394 | Gorin et al. |
| | 3,188,179 | Gorin |
| | 3,194,644 | Gorin et al. |
| | 3,516,808 | Curran et al. |

These patents are hereby incorporated by reference. In the use of such processes, it has been found that lower rank coals such as lignite are substantially more reactive. Higher rank coals such as bituminous coals, anthracite and the like are much less reactive and require the use of very large equipment to achieve effective gasification rates. The bottoms product produced by the liquefaction of such higher rank coals is normally also relatively nonreactive in such processes. Further it has been found in such processes that upon continued recycling the $CO_2$ acceptor compound becomes less active and requires replacement.

In the preparation of the subject application the following references were also considered:

| | | |
|---|---|---|
| U.S. Pat. No. | 2,894,897 | Post |
| | 2,953,361 | McKinley et al. |
| | 2,953,518 | McKinley et al. |
| | 3,033,779 | Fidelman |
| | 3,702,516 | Luckenbach |
| | 3,702,819 | Metrailer |
| | 3,707,462 | Moss |
| | 4,075,079 | Long |
| | 4,097,361 | Ashworth |

These references are hereby incorporated by reference.

There has also been a continuing interest in recent years in the liquefaction of coal by processes which comprise in general the extraction of coal by a distillable solvent in the presence of hydrogen under conditions selected to produce a coal liquefaction product a major portion of which is distillable. The liquefaction product is then separated into a distillable fraction and a bottoms fraction which typically contains not only the nondistillable or more difficultly distillable portions of the liquefaction product but also the unreacted coal, ash and other solid constituents of the coal liquefaction product. One commonly used way to separate the distillable portion of the coal liquefaction product from the bottoms fraction is vacuum distillation. Such distillation is normally controlled to produce a distillable product stream and a flowable bottoms fraction which is normally flowable at elevated temperatures, i.e. in the vicinity of 600° F. even though the retention of flowable properties in the bottoms fraction may require that a portion of the distillable fraction and possibly even a portion of the distillable solvent be left in the bottom fraction. One such process is shown in U.S. Pat. No. 4,094,766 issued June 13, 1978 which is hereby incorporated in its entirety by reference.

Attempts have been made heretofore to reduce the caking tendencies of caking coals and to increase the reactivity of such caking coals by treating the coals with aqueous calcium oxide slurries. Such processes have required pressurized treatment with aqueous calcium oxide slurries and have not in general been directed to the treatment of a liquefaction bottoms fraction. One such reference is entitled "A Novel Approach to Coal Gasification Using Chemically Incorporated CaO (Phas II)." Summary report, April 1976–May 1977, by Feldmann, H. F.; Chauhan, S. P.; Longanbach, J. R.; Hissong, D. W.; Conkle, H. N.; Curran, L. M.; Jenkins, D. M. Battelle Columbus Labs., Ohio (USA), BMI—1986318 pp. 11, November 1977. This reference is hereby incorporated in its entirety by reference. The reference notes that the physical impregnation of coal with calcium oxide is much less effective than the approach disclosed in the reference.

In view of the continuing interest in liquefaction processes, it appears that there will be a continuing interest in methods for treating the liquefaction bottoms fraction since this stream normally contains substantial amounts of carbonaceous material and is potentially a feed source for processes for the production of valuable products such as synthetic fuels, hydrogen for the liquefaction process and the like.

Accordingly, it has now been found that such bottoms fractions are desirably gasified by mixing the bottoms fraction with at least one finely-divided calcium compound selected from the group consisting of calcium oxide, calcium carbonate and calcium hydroxide of a size consist no larger than about −200 Tyler mesh with the calcium compound being added in an amount sufficient to produce aggolmerate particles upon mixing with the bottoms fraction with the resulting agglomerate particles being gasified by reaction with steam in a fluidized bed.

Figure 2:
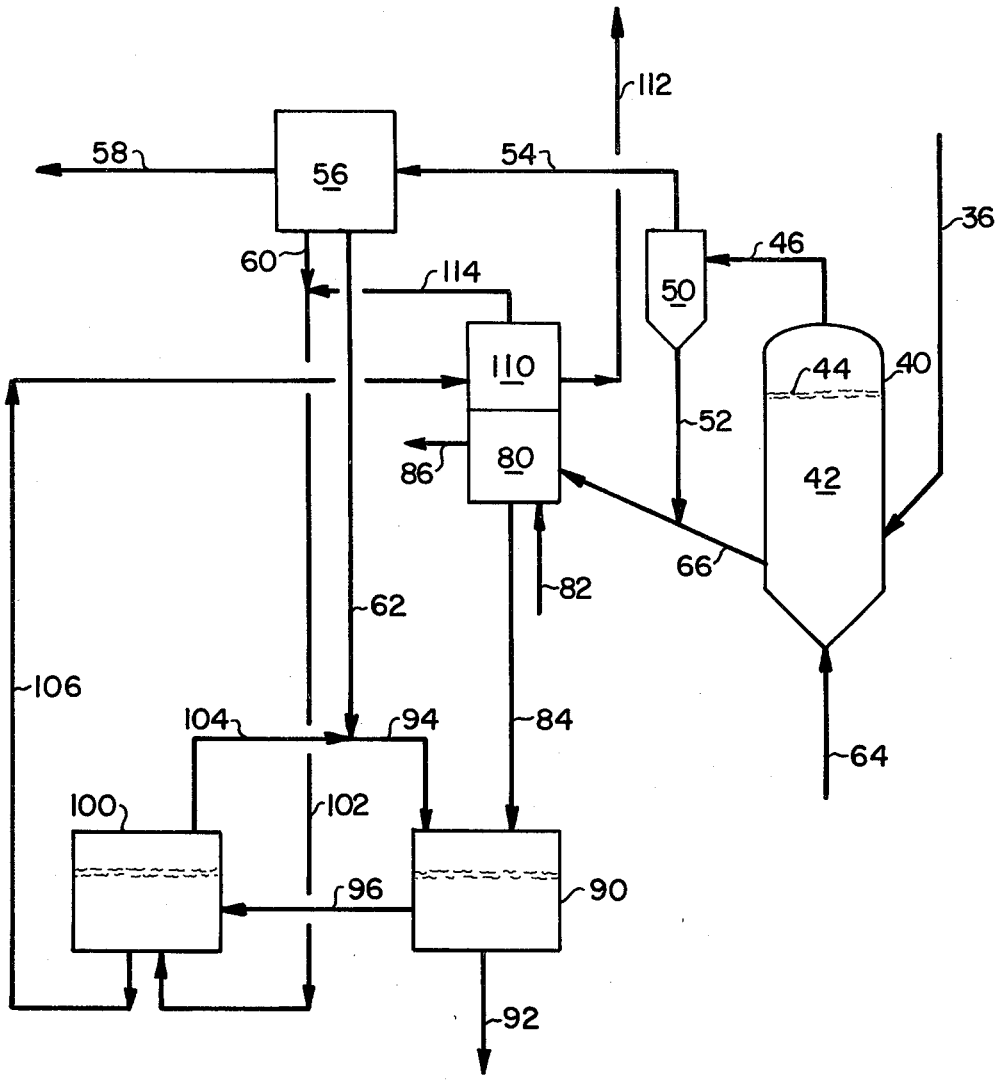

FIG. 1 is a schematic diagram of a process embodying the method of the present invention; and, FIG. 2 is a schematic diagram of a process for the recovery of calcium values from the ash stream produced upon the gasification of the agglomerates of the liquefaction bottoms fraction and the calcium compound.

In the discussion of the Figures, the same numbers will be used to refer to the same or similar components throughout.

In FIG. 1, a process is shown wherein a liquefaction bottoms fraction is produced by a coal liquefaction process depicted generally by the numeral 10 with the coal liquefaction product being recovered through a line 12 and passed to a vacuum still 14 wherein it is separated into a distillable product recovered through a line 16 and passed to further processing and a bottoms fraction recovered through a line 18 and passed to a vessel 20. In vessel 20 the bottoms fraction is mixed with a calcium compound added through a line 22. Vessel 20 includes a mixer 24. The calcium compound is added in an amount sufficient to produce agglomerates of calcium compound and bottoms fraction upon mixing. The resulting agglomerates are removed from vessel 20 via a line 28 and passed to a screen 30 where they are separated into agglomerates of a desired size i.e. larger than about 100 Tyler Mesh and an undersize agglomerate stream (smaller than about 100 Tyler Mesh) which is recovered through a line 32 and passed back to line 18 for recycle to vessel 20. It has been found that an amount of calcium compound sufficient to produce agglomerate particles upon mixing with the bottoms fraction is suitably at least about 40 weight percent and typically more than about 50 weight percent and preferably up to about 65 weight percent based upon the weight of the bottoms fraction. The resulting agglomerates recovered from screen 30 are passed via a line 36 to a gasification vessel 40 which contains a fluidized bed 42 which is maintained in a fluidized condition by the injection of steam through a line 64. The fluidized bed is maintained at a level 44 somewhat below the top of vessel 40 so that gases are recovered from the upper portion of gasifier 40 via a line 46 and passed to a cyclone 50 where entrained solid particles are separated from the gaseous stream and recovered through a line 52. The gases are then recovered through a line 54 and passed to a gas purification section 56 where materials such as hydrogen sulfide and carbon dioxide are recovered lines 60 and 62 respectfully. The product gas is recovered through a line 58 and passed to use as a fuel, further processing to produce hydrogen, synthetic natural gas or the like. The solids recovered through line 52 are passed to a line 66 which carries a flow of material withdrawn from gasifier 40 and passed to calcium regeneration in an ash removal section 70. In section 70, ash is removed as shown through a line 72 with calcium values recovered being recycled through a line 74 to line 22 for addition to vessel 20. Calcium regeneration and ash removal can be by any of a variety of techniques known to those skilled in the art although one preferred embodiment is depicted in FIG. 2.

Vessel 20 is normally operated at a temperature from about 550° to about 650° F. at atmospheric pressure although it is noted that the vessel may be enclosed if desired to prevent the escape of pollutants into the atmosphere and the like. Gasifier 40 is normally operated at a temperature from about 1450° to about 1550° F. and at a pressure from about 11 up to about 13 atmospheres (atms).

In FIG. 2, the solids stream recovered from gasifier 40 is passed through line 66 to an incinerator 80 where the stream is burned by injecting a stream of air through a line 82 to produce ash, calcium oxide and other combustion products. A good deal of heat is produced and is used to convert calcium carbonate to calcium oxide in a calciner 110. The resulting residual calcium compounds and the ash are passed through a line 84 to a vessel 90 where the residual solids are contacted with hydrogen sulfide in an aqueous solution. The calcium compounds present as calcium oxide are reacted with the hydrogen sulfide to produce calcium hydrosulfide—$Ca(HS)_2$ which is water soluble. Hydrogen sulfide is supplied to vessel 90 via a line 94 with the water insoluble, residual calcium compounds and ash being discarded from vessel 90 through a line 92. The aqueous solution containing the calcium hydrosulfide is recovered through a line 96 and passed to a zone 100 where the aqueous solution containing the calcium hydrosulfide is contacted with carbon dioxide, supplied to vessel 100 through a line 102, which reacts with the calcium hydrosulfide to produce calcium carbonate which is precipitated. The precipitated calcium carbonate is recovered through a line 106 and passed to calciner 110. Hydrogen sulfide is produced by the reaction in vessel 100 and is recovered through a line 104 and passed to line 62, with line 62 and line 104, joining line 94 to provide hydrogen sulfide to vessel 90. Makeup hydrogen sulfide can be added if required although such is not shown in the Figure. The calcium carbonate so produced is passed to incinerator 110 where it is heated to produce calcium oxide which is recovered through a line 112 and passed to recycle to vessel 20 or the like. The carbon dioxide so produced is recovered through a line 114 and passed to line 102. Vessel 90 is typically operated at approximately 100° F. and may be at about 1 atmosphere pressure. Vessel 100 is typically operated at a temperature of about 100° F. and a pressure from about 1 to about 2 atm.

It is noted that a variety of methods could be used to recover calcium values from the residual materials produced by the gasification of the bottoms fraction in gasifier 40. While the process shown in FIG. 2 is the presently preferred embodiment it is recognized that other methods could be used.

By the use of Applicant's claimed method, the reactivity of the liquefaction bottoms fraction has been increased to a level such that it is readily gasified in fluidized bed 42 to produce valuable fuel products. Further, by the process of the present invention the recycle of calcium oxide materials from a fluidized bed contained in a gasifier such as vessel 40 to an incinerator to produce $CO_2$ acceptor for recycle to the fluidized bed has been eliminated since substantially all the calcium compounds passed to gasifier 40 are recovered in finely-divided form with the gaseous products or with the char stream and are subjected to chemical treatment to regenerate the materials as fresh calcium oxide which is then blended with additional bottoms fraction materials. Clearly two areas which have presented problems to the art have been resolved by Applicant's claimed method and result in an effective method for gasifying the bottoms fraction from a coal liquefaction process.

Having thus described the invention by reference to certain of its preferred embodiments it is respectfully pointed out that the foregoing embodiments while preferred are illustrative rather than limiting in nature and that many variations and modifications are possible within the scope of the present invention. Many such variations and modifications may be considered obvious and desirable by those skilled in the art upon a review of the foregoing description of preferred embodiments.

Having thus described the invention, I claim:

1. A method for gasifying the bottoms fraction from a coal liquefaction process wherein coal is liquified by extraction of said coal by a distillable solvent in the presence of hydrogen under conditions selected to produce a coal liquefaction product, a major portion of which is distillable, said liquefaction product being subjected to vacuum distillation to separate at least a major portion of the distillable fraction of said liquefaction product and at least a major portion of said solvent from said bottoms fraction, said bottoms fraction being flowable at elevated temperatures, said method consisting essentially of (a) mixing said bottoms fraction with at least one finely-divided calcium compound, said calcium compound being selected from the group consisting of CaO, $CaCO_3$ and $Ca(OH)_2$ and of a size consist no larger than about −200 Tyler mesh, said calcium compound being added in an amount sufficient to produce agglomerate particles larger than about 100 Tyler mesh upon mixing with said bottoms fraction said amount being greater than about 40 weight percent based on the weight of said bottoms fraction; and (b) gasifying at least a portion of said agglomerates by reacting said agglomerates with steam in a fluidized bed to produce a hydrogen-rich fuel gas.

2. The method of claim 1 wherein residual calcium compounds and ash are withdrawn from said fluidized bed and wherein at least a portion of said calcium recovered and recycled to mixture with said bottoms fraction.

3. The method of claim 2 wherein said residual calcium compounds and ash are contacted with aqueous hydrogen sulfide to produce $Ca(HS)_2$ which is separated from insoluble residual calcium compounds and said ash.

4. The method of claim 3 wherein said $Ca(HS)_2$ is contacted with aqueous $CO_2$ to produce $CaCO_3$.

5. The method of claim 4 wherein said $CaCO_3$ is recovered and incinerated to produce CaO.

6. The method of claim 1 wherein said calcium compound is added in an amount equal to form about 40 to about 65 weight percent based on the weight of said bottoms fraction.

* * * * *